United States Patent [19]

Zink et al.

[11] 4,080,883

[45] Mar. 28, 1978

[54] AIRRESTER

[75] Inventors: John S. Zink; Robert D. Reed; Robert E. Schwartz, all of Tulsa, Okla.

[73] Assignee: John Zink Company, Tulsa, Okla.

[21] Appl. No.: 728,069

[22] Filed: Sep. 30, 1976

[51] Int. Cl.[2] ..... F23L 17/02

[52] U.S. Cl. ..... 98/58; 110/184; 431/202

[58] Field of Search ..... 98/58, 59, 60; 431/202.5; 110/184; 138/44, 113, 114; 432/72; 48/192

[56] References Cited

U.S. PATENT DOCUMENTS

| | | | |
|---|---|---|---|
| 3,662,669 | 5/1972 | Cullinane | 98/60 |
| 3,780,639 | 12/1973 | Wood | 98/58 |
| 3,893,810 | 7/1975 | Lientz | 431/.5 |

FOREIGN PATENT DOCUMENTS

| | | | |
|---|---|---|---|
| 136,252 | 12/1919 | United Kingdom | 98/58 |

*Primary Examiner*—William E. Wayner
*Assistant Examiner*—R. J. Charvat
*Attorney, Agent, or Firm*—Head, Johnson & Chafin

[57] ABSTRACT

An improved construction for an upwardly extending flare stack for the emergency venting to the atmosphere of large quantities of combustible gases, such improvement being for the purpose of preventing the inflow, and upstream flow of air, into the flare stack, comprising an annular obstruction means attached to the inner surface of the flare stack a short distance upstream of the downstream end of the stack.

2 Claims, 10 Drawing Figures

AIRRESTER

BACKGROUND OF THE INVENTION

This invention lies in the field of flare stacks, for the purpose of emergency venting to the atmosphere of large quantities of combustible (waste of vent) gases. More particularly, it concerns the design of the flare stack, with means for the prevention of the inflow of atmospheric air into the top of the stack, and down along the inner surface of the stack, where it can mix with the outflowing combustible gases, and cause explosions.

In refineries, petrochemical plants and similar plants, there must be provided field flares which are designed for the emergency venting to the atmosphere of huge quantities of combustible gases, at irregular intervals. These are standby devices, which must be ready at all times to take the vented gases and burn them, as vented to the atmosphere. In between the times when the large flow of combustible gas is vented, while there is a minimum flow of purge gas, there is possibility of inflow of atmospheric air into the stack, and its flow down the stack, creating a combustible mixture in the stack which may, under certain conditions, explode and cause considerably damage.

While the emergency vented gases are flowing through the system, they are generally moving at high speed, of the order of 200 feet/second, or more, and turbulent flow conditions prevail. However, in the standby condition, when the vented gases are no longer flowing a standby flow of purge, or sweep, gases is provided. In view of the cost of the gas, its flow rate is minimal, of the order of 0.05 feet/second, more or less. The flow condition of the purge or sweep gases is laminar, or non-turbulent, at least for a very great preponderance of the time of flow. The laminar flow condition is that which makes avoidance of air entry to the flare stack and flare system difficult, because the prevention of air entry into the stack is due to the kinetic energy of the gases. In laminar flow, the velocity with which purge gases move is not uniform across the entire cross-section of the flare stack, and flare system tubular members, where pipe or round ducts are typically used.

Laminar flow is described in Mark's *Mechanical Engineers Handbook*, McGraw-Hill as follows:

> "If the forced movement of fluid through a filled pipe occurs as a telescopic sliding of adjacent layers of fluid without transverse mixing, the resistance of this type of movement is due entirely to molecular forces. In long straight pipes, the velocity is near zero near the wall, and reaches its maximum in the center, along the axis of the pipe. The velocity distribution is parabolic, the maximum velocity (at the axis) is twice the average velocity. Since each laminum or layer of fluid retains its identity, this flow is called 'laminar'. "

For a vertically oriented stack, (angle greater than 45° to the horizon) and with laminar, low velocity flow, the gas velocity is practically zero along the inner surface of the stack. It is possible therefore for air to enter the top of the stack, along the edge of the stack, and flow down the inner surface of the stack in this narrow annular zone, of very low gas velocity. There will be consequent mixing of the downflowing air with the combustible gas, which can provide an explosive mixture. This presents a real danger to the operation of the flare stack.

It is to be noted that, when all else is equal, this air entry can occur only when the essentially static mass of gases contained within the vertically-oriented flare and flare-riser is composed of gases at molecular weight less than 28.97 (air), and therefore buoyant in respect to air. But even if the flare and flare riser are filled with heavy gases at the termination of the flare-relief period (where heavy gases present no air infiltration hazard) it is typical to make use of light gases which have molecular weights less than 28.97 for purge gases, and these gases soon replace the heavier gases contained within the flare and flare riser, and the air entry hazard becomes substantially constantly present because of this. A further source of air entry to the flare is due to wind-turbulence at the discharge point of the flare, and this effect is virtually constantly present at typical flare elevations, and air turbulence merits consideration for that reason because of wind movement at velocity is seldom less than 7feet/second and maybe as high as 135feet/second (5 mph to 90 mph).

SUMMARY OF THE INVENTION

It is a primary object of this invention to provide a construction of a flare stack which will prevent the downflow of atmospheric air inside of the flare stack, along the inner surface, during the periods in which a low velocity flow of purge gas is provided.

It is a further object of this invention to provide a simple type of internal construction of the flare stack that will prevent the downflow of atmospheric air even with a low rate of flow of purge gas.

These and other objects are realized and the limitations of the prior art are overcome in this invention by construction of an annular obstacle attached to the inner surface of the flare stack. The plane of the obstacle is normal to the axis of the stack. The radial width of the annular obstacle is of the order of 10% of the diameter of the stack, more or less.

The obstacle can be a simple plane annular ring plate, which is welded to the inside of the stack. The annular plate can also be an annular conical surface, or an annular flared surface. Each of these can be used alone or with an extended conical trailing portion, which is attached at its largest diameter to the opening in the annular obstacle.

In another embodiment, the orifice, or passage through the obstacle, comprises a thin tube of diameter equal to the inner diameter of the annular plate, the tube being coaxial with the opening through the plate, and extending upstream and downstream from the plate.

BRIEF DESCRIPTION OF THE DRAWINGS

These and other objects and advantages of this invention and a better understanding of the principles and details of the invention will be evident from the following description taken in conjunction with the appended drawings in which.

DESCRIPTION OF THE PREFERRED EMBODIMENTS

Figure 1:
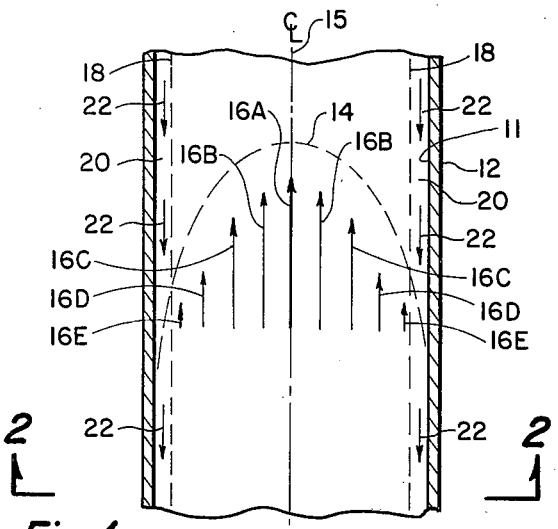
Fig. 1 (PRIOR ART)
FIGS. 1 and 2 show the prior art condition of a straight cylindrical, tubular, flare stack.
Figure 2:
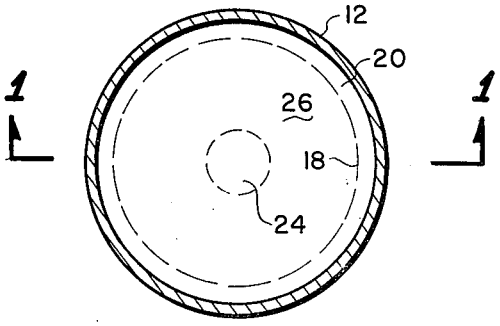
Fig. 2 (PRIOR ART)

Referring now to the drawings, there is shown in FIGS. 1 and 2, two views of a conventional flare stack 12. The dashed parabolic curve 14 is the well known characteristic of the laminar flow of fluid through the cylindrical pipe 12. This indicates that there are annular cylinders of fluid which flow at different velocities through the pipe. In the center along the axis 15, the velocity of flow indicated by arrow 16A is the greatest. At different radi outwardly from the axis 15, for example, the velocity of the laminum 16B is less than that at the center. At still greater radius the laminum 16C is less than 16B, and so on, up to a point near the inner surface of the flare stack, the velocity 16E is quite small, approaching a velocity of almost zero at the wall.

When the vent gases are flowing through the pipe 12, the high rate of flow of the order of 200 feet per second causes the flow to be turbulent, and the flow rate at all radii are substantially equal. However, when the flow rate is small, as when the purge or sweep gases are supplied, during the periods when the vent gases are not available, the flow rate is so slow that the flow is laminar, and has the flow characteristic of velocity versus radius shown by the curve 14.

If the upwardly flowing purge gases are of lesser density than air, it will be clear that air will flow downwardly, by gravity, in the less dense gas. This is true except where the upward velocity of the gas is great enough to displace the air upwardly, in spite of its greater density. Thus the kinetic energy of the gas can prevent air entry. However, there will be a narrow annular zone 20 between a cylindrical surface 18 and the inner surface 11 of the pipe 12, where the upward velocity of the low density gases is insufficient to displace the air upwardly. Consequently air will then flow, or migrate downwardly along the inner surface 11, of the flare stack, in accordance with arrows 22, and mix with the outwardly flowing purge gases in accordance with arrows 16, forming a dangerous mixture in that annular space 20.

FIG. 2 shows a cross-section taken along the plane 2—2 of FIG. 1 and shows the central zone 24 of high velocity gas 16A, a larger annular volume 26, in which the velocity is nominal, and the narrow annular volume 20 wherein the upward velocity of the gas is insufficient to prevent the entry of air, which flows downwardly in accordance with the arrows 22 of FIG. 1.

Figure 3:
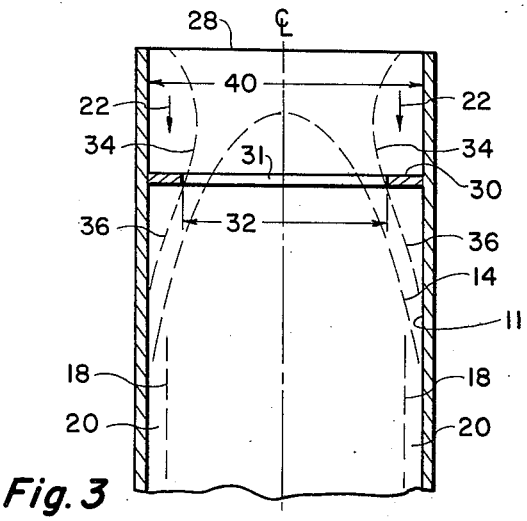
FIGS. 3 and 4 show an obstacle comprising a narrow annular ring plate welded to the inner surface, alone, and also with a conical extension to the opening through the plate.

Because of the inherent hazard resulting from this downward flow of air, something must be done to prevent the downflow of air 22, and this is accomplished by the present invention, for which there are several embodiments. Referring now to FIG. 3, there is shown the top portion of a flare stack 12, including the top edge 28, of the flare stack. There is also drawn in dashed line the parabolic velocity characteristic of the laminar flow of gas up the pipe, which is similar to that shown in FIG. 1. At a point near the top of the stack, there is an obstacle 30 positioned inside of and sealed to the inner surface 11 of the stack 12.

In this first embodiment the obstacle comprises a plane, annular, ring plate 30, which is welded at its outer circumference to the inner wall 11 of the pipe, and has a central opening 31 of diameters 32.

While the present invention is described in terms of a circular cross-section of the flare stack, it will be clear that the cross-sectional area can be round, rectangular, or of any multi-sided convex shape that might be chosen. Furthermore, if the stack is circular in cross-section, it is possible to have the central opening 31 in the obstacle 30 concentric with the outer contour of the ring, or offset with respect to the axis. A symmetrical, circular, concentric ring is the preferred embodiment.

The spacing of the ring 30 with respect to the top 28 of the stack is not critical. However, it should be positioned close to the top since its design is intended to prevent the migration of air down the inside surface of the pipe in accordance with arrows 22. The nearer it is to the top surface the better is the air excluded from the inside of the stack.

In an orifice 31, in the center of the obstacle 30, there will be a flow of gas indicated by the dashed lines 34 and correspondingly, a flow line or surface 36 preceding the flow through the orifice plate, or obstacle 30.

At some distance below the plate 30, as explained in connection with FIG. 1, there is an annular zone 20 which comprises a very slow moving portion of the cross-section, where the upward rate of flow of gas is a minimum. As the flow passes through the orifice 31 it assumes a higher flow velocity. Since the cross-section is somewhat reduced, the average flow velocity is correspondingly greater. Therefore, at the outer boundaries of the flow stream, along the streamline 34, the velocity is high enough to provide sufficient energy to overcome the differential density of air, and to prevent the downward flow of air between the upflowing gas and the inner edge of the orifice plate 30. Consequently, any air that may have leaked into the stack above the plate 30, cannot proceed downward farther than the plate 30. Therefore, there is no danger of the progress of the air below the position of the plate 30.

While the plane annular ring plate 30 can be used alone to provide an orifice 31 as described in FIG. 3, it is possible, and desirable to provide a conical surface 42, that is attached, as by welding, to the opening 31 in the plate 30. This conical angle 50 of this skirt, which extends downstream from the orifice plate 30, has a length 44 which is of the same order of magnitude as the diameter 32 of the internal opening. Because of the taper 50, it is clear that the diameter of the outlet opening 46, will be less than the diameter 32 of the opening 31.

Attention is called to the flow surface 34 of FIG. 3. In a similar manner there will be an internal flow surface 43 due to the sharp entering edge of the orifice opening 31, which more or less follows the surface of the conical member 42.

Figure 4:
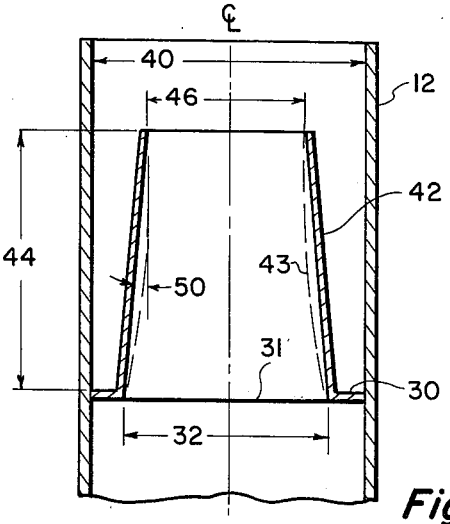
Figure 5:
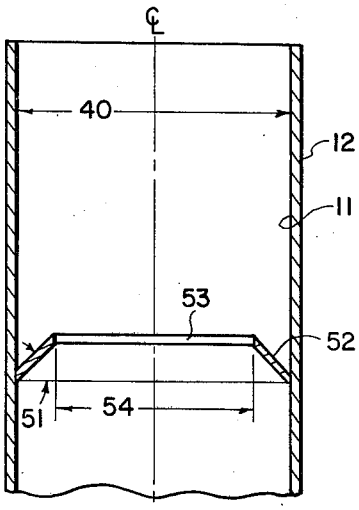
FIGS. 5 and 6 show embodiments having a wide angle annular conical plate welded to the inner surface of the flare stack, both with, and without, a conical extension to the opening through the annular system.

In FIGS. 4 and 5, there are variations of the embodiments of FIGS. 3 and 4, where instead of providing a planar orifice plate 30, a conical plate 52 is provided. The angle 51 of the conical surface 52 is not critical, and can be of the order of 45°, for example. Similarly, there is a concentric opening 53 of diameter 54. An action similar to that described in connection with FIG. 3 will be observed with this embodiment.

Figure 6:
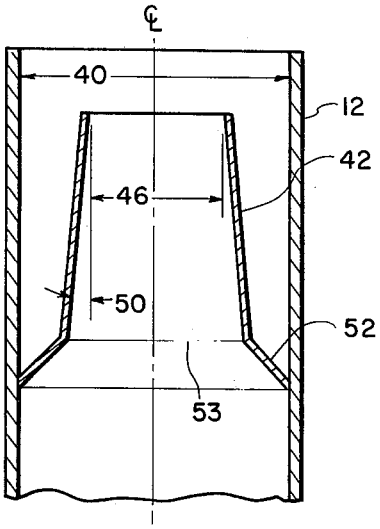

In FIG. 6, an embodiment similar to FIG. 4 is shown wherein a truncated conical surface 42 of small conical angle is provided, where the larger end is welded to the inner edge of the opening 53 of the conical plate 52. Here again the action is similar to that described in detail in connection with FIG. 4.

Figure 7:
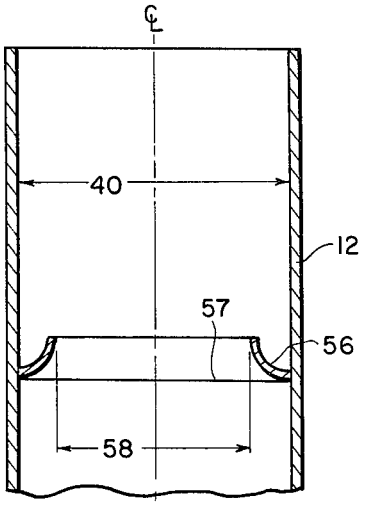
FIGS. 7 and 8 show embodiments with an annular flared section welded to the inner surface of the stack, with, and without, a conical extension of the central opening.
Figure 8:
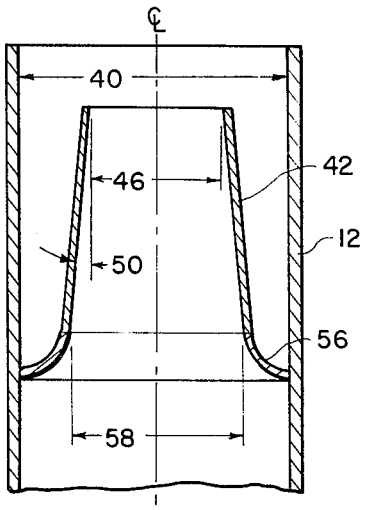

In FIGS. 7 and 8, there are two additional embodiments similar to the embodiments of FIGS. 3 and 4, wherein an annular flared plate 56 is used, in comparison with the planar plate 30, and the conical plate 52. Again, the action is similar and further description does not appear to be necessary.

Figure 9:
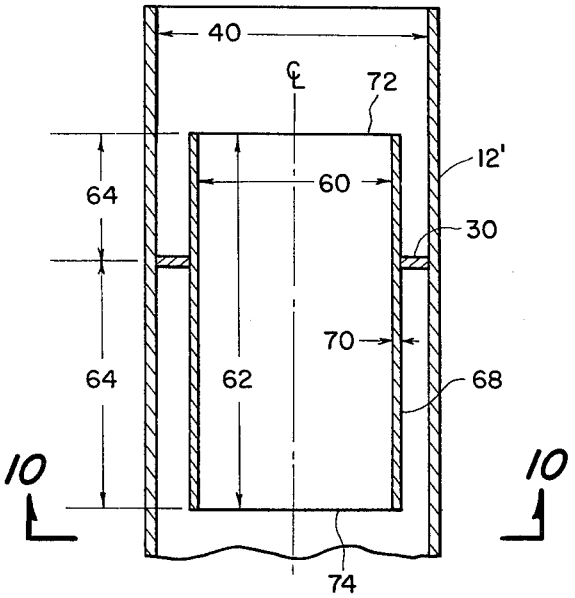
FIGS. 9 and 10 show two views of an embodiment in which a thin cylindrical tube is welded into the central opening through the narrow annular ring plate of FIG. 3.
Figure 10:
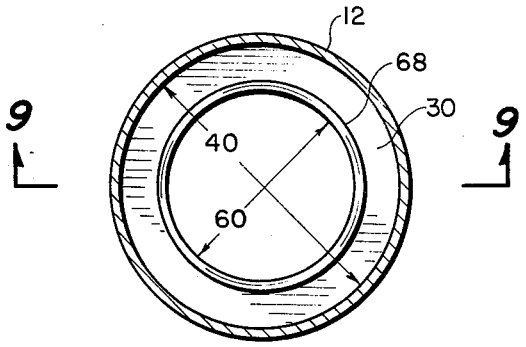

Another form of the obstacle attached to the inner surface of the flare stack, is indicated in FIGS. 9 and 10. In this embodiment the annular planar plate 30 is provided as in FIG. 3, and a long orifice in the form of a thin-walled cylindrical tube 68 is provided of thickness 70, which is welded into position along the inner edge of the opening 31 in the plate 30. The length 62 of this thin walled cylinder 68 is equal to or greater than the diameter 60, which is substantially the diameter 31 of the opening in the plate 30. This cylindrical tube 68 can be attached to the annular plate 30, with its downstream edge flush with the plate 30, or with its upstream edge 74 positioned flush with the plate 30. This would then be a similar embodiment to FIG. 4, except for a cylindrical walled portion, as against a conical walled portion. However, in this embodiment it is preferred that the support 30 be attached at some intermediate point between the downstream and upstream edges 72 and 74 respectively. A preferred position is to have the downstream portion 64 approximately two-thirds of the upstream portion 64. In other words, approximately 0.4 of the length 62 projects downstream, and 0.6 of the length 62 projects upstream.

What has been described is an improved construction of a flare stack which includes on its inner surface near the top of the stack, an annular obstruction, having an internal opening which is of a lesser diameter than that of the pipe itself. The radial width of the obstruction is greater than the annular zone inside of the full pipe where the velocity of the gas flow of the purge gases is less than that which would exclude air from flowing down the inside walls of the stack.

On the assumption that a certain velocity V of flow of the gas is required to prevent the downward flow of air, it will be clear that if the radius of the inner edge of the annular obstruction is in a zone where the laminar velocity is greater than V, there will certainly be, at all cross-sections of the gas flowing through the inner opening, a velocity which is greater than V, because all of the gas, including that outside of the radius of the inner edge is now flowing through this opening. Consequently, it will be clear that there is at no point within the cross-section within the opening of the obstruction, a velocity below which the air can be excluded. Therefore, it will be impossible for the air to migrate below the plate 30 so long as the purge gases are flowing at the assumed total velocity.

The obstacle can be as simple a construction as an annular plate, or annular conical portion or an annular flared portion, with or without cylindrical or conical tubular members attached to the inner opening in the obstacle.

In another way, the obstacle can be described as an orifice which can be as simple as a plate with a sharp central opening or a longer orifice comprising a plate with a coaxial tube of shorter or longer dimension.

No dimension is specified for the radial width of the annular ring (or obstacle). It is clear that it must be wide enough to provide a high enough gas velocity during the flow of purge gas through the orifice to prevent entry of air. For this purpose the wider the better.

However, since all of the large flow of vent gas must also flow through this orifice, it must be as large as possible to avoid having too great a pressure drop, which might affect the flow of vent gas.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. In an upwardly extending flare stack for emergency venting to the atmosphere of large quantities of combustible gases, wherein during "standby" condition, when said combustible gases are not being vented, a small maintenance flow of purge gas is provided, for the purpose of maintaining said stack free of air, the improvement in construction of said flare stack to ensure air-free conditions, comprising;

an annular ring plate mounted perpendicular to the axis of said stack inside said stack near the downstream end thereof, said annular ring plate providing an orifice of smaller cross-sectional area than said stack;

a thin-walled cylindrical tube of length at least equal to the diameter, sealably attached to the inside of said annular ring plate, a part of said tube extending upstream of said ring plate and part extending downstream;

whereby said maintenance flow of gas will flow through said orifice at a higher circumferential flow rate than the circumferential flow rate at the inner surface of said stack to prevent the upstream flow of air along the inner surface of said stack.

2. The flare stack as in claim 1 in which the part extending upstream is greater than the part extending downstream.

* * * * *